United States Patent [19]

Gilbert et al.

[11] 4,132,039

[45] Jan. 2, 1979

[54] ABRASIVE BLASTING APPARATUS

[75] Inventors: Neal J. Gilbert, Highland; Edward L. Horton, El Monte, both of Calif.

[73] Assignee: Enviro-Blast International, Los Angeles, Calif.

[21] Appl. No.: 767,348

[22] Filed: Feb. 10, 1977

[51] Int. Cl.[2] ..... B24C 3/06

[52] U.S. Cl. ..... 51/424; 51/429

[58] Field of Search ..... 30/424, 425, 429, 431, 30/432, 433, 434; 15/346, 357

[56] References Cited

U.S. PATENT DOCUMENTS

| | | | |
|---|---|---|---|
| 2,732,666 | 1/1956 | Powell | 51/431 |
| 3,566,543 | 3/1971 | Fogle | 51/429 X |
| 3,777,440 | 12/1973 | Yamanoto | 51/431 |
| 3,872,625 | 3/1975 | Fuma | 51/429 X |
| 3,916,568 | 11/1975 | Rose | 51/429 |
| 3,918,209 | 11/1975 | Crawley | 51/47 X |
| 4,020,597 | 5/1977 | Shigyo | 51/429 X |

FOREIGN PATENT DOCUMENTS

| | | | |
|---|---|---|---|
| 2407674 | 10/1974 | Fed. Rep. of Germany | 51/429 |

*Primary Examiner*—Gary L. Smith
*Attorney, Agent, or Firm*—Paul A. Weilein

[57] ABSTRACT

A lightweight hand operated abrasive blasting apparatus operatively connected with a remote station arranged to provide an air stream with a particulate abrasive material, and an air suction, the apparatus having a housing with an open side facing a work surface that is to be blasted. The abrasive, such as steel grit, is carried to the center of an impeller wheel which centrifugally projects the abrasive in the form of a transversely elongated stream against the work surface, and a vacuum line connected with the housing draws the spent abrasive particles along with particles of material removed from the surface and delivers the material to the remote station for separation and reclaiming of the abrasive particles. A resilient skirt extending from the housing provides a sealed connection with the work surface, and is provided with air flow openings which are normally closed by resilient valving flaps which are automatically operable in response to variations in the suction pressure within the housing, to control the admission of outside air into the housing in sufficient amounts to enable movement of the housing over the work surface. Adjustable ball thrust members support the housing for movement over the work surface. The abrasive stream is adjustably rotatable about its axis to vary its orientation on the blasted surface and permit the width of the blast area to be varied between a predetermined minimum and maximum, when the housing is moved in a predetermined direction.

11 Claims, 9 Drawing Figures

FIG. 1.
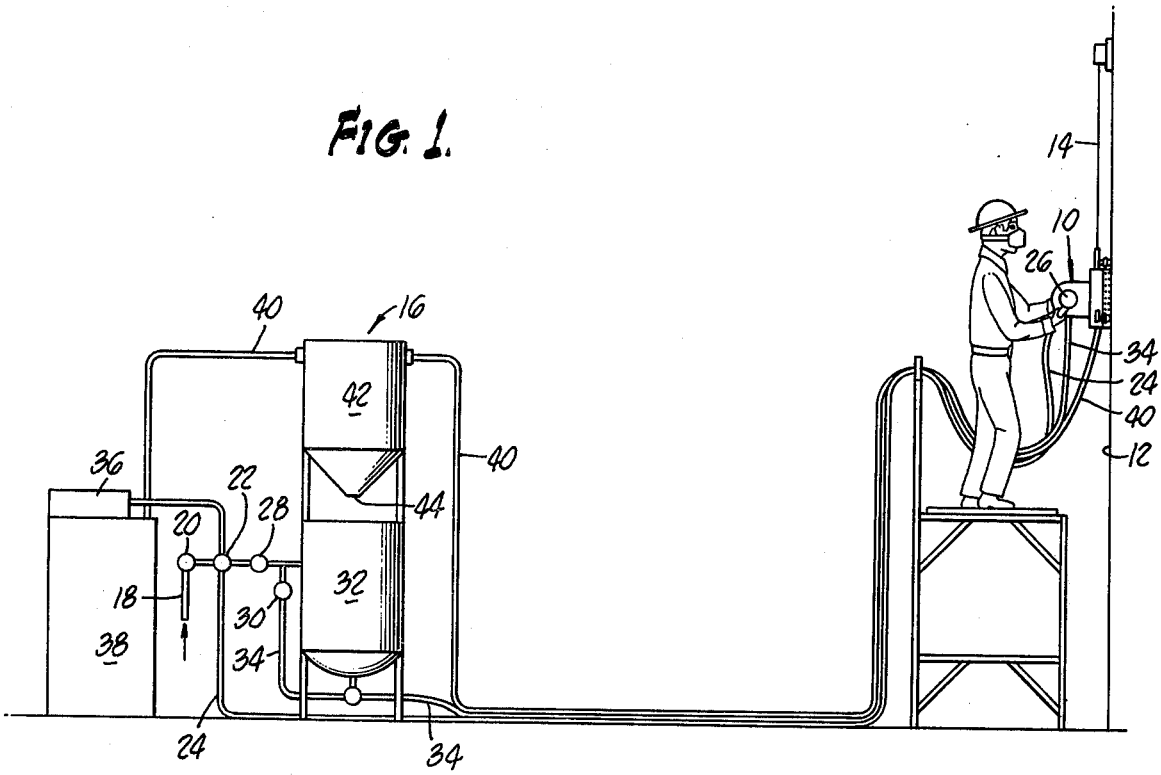
FIG. 7.
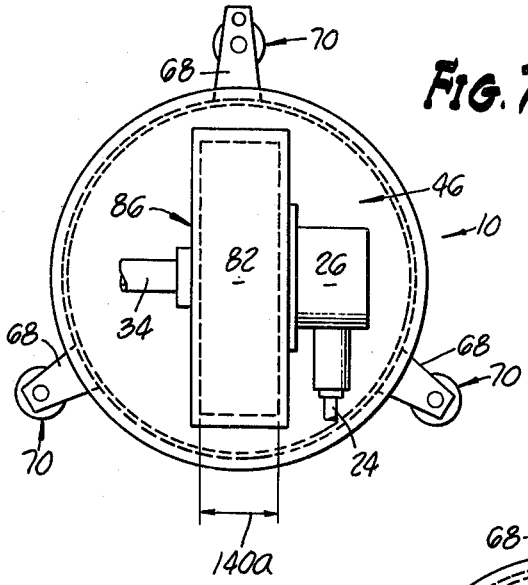
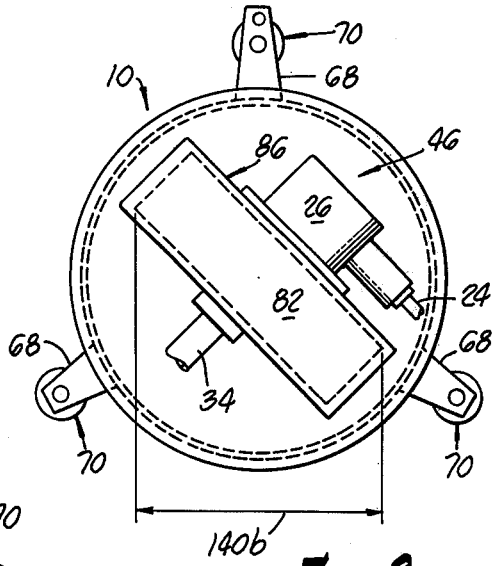
FIG. 8.
FIG. 9.
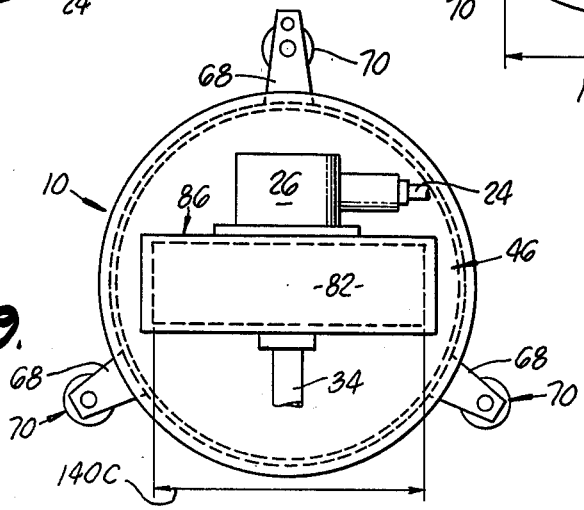

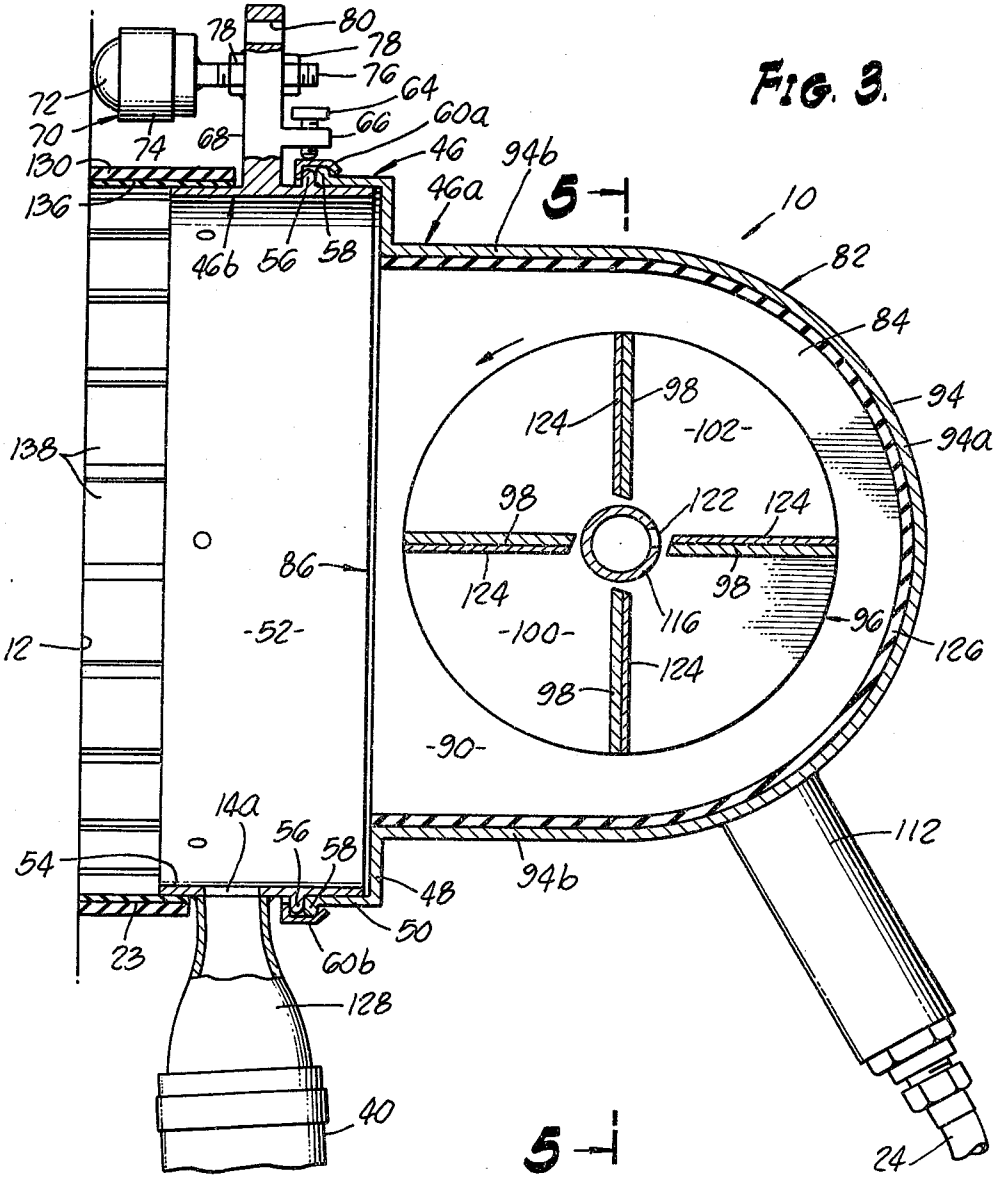
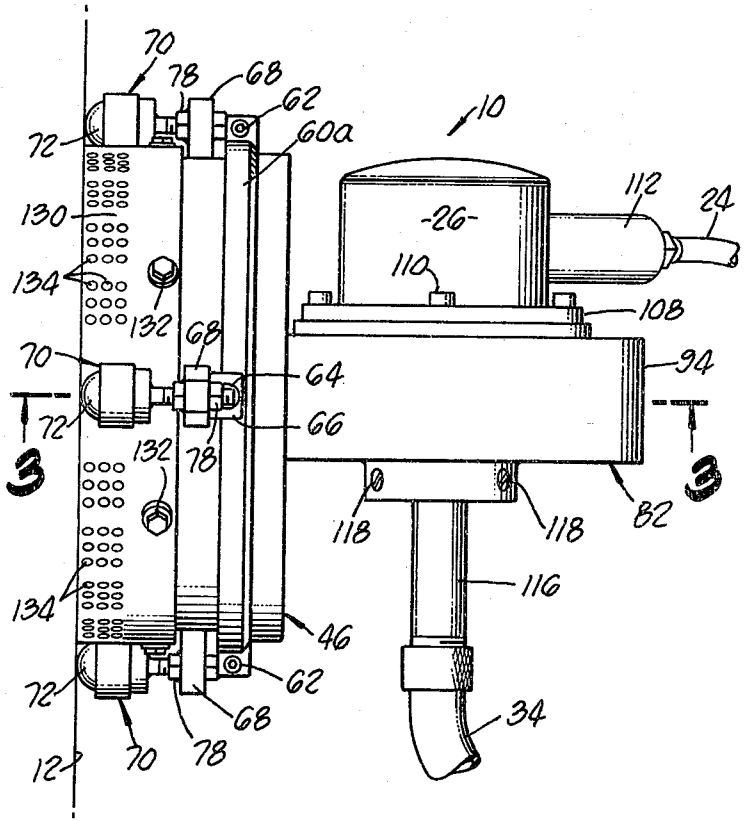
FIG. 2.

ABRASIVE BLASTING APPARATUS

BACKGROUND OF THE INVENTION

The invention relates generally to the field of treating work surfaces.

It has been known heretofore to clean working surfaces by means of abrasive blasting machines or apparatus of the general character disclosed in the Rose et al. U.S. Pat. No. 3,916,568; the Mead et al. U.S. Pat. No. 2,494,773; and the Bishop et al. U.S. Pat. No. 2,483,176. The blasting machines of these patents are dependent upon the use of a cleaning head in which a nozzle is moved to direct an abrasive-laden high velocity air stream against the working surface. The blasting machines of the character disclosed in these patents have the problem of removing the large amounts of air supplied in the nozzle stream through the air suction connection to the housing, and thus do not achieve the desired automatic balance of incoming and outgoing air within the housing adjacent to the work surface. Moreover, the nozzle stream is of uniform transverse configuration, or the nozzle is moved in a path such that the width of the blasted area will be substantially the same irrespective of the direction of movement of the housing over the work surface.

In order to overcome inherent disadvantages of blasting machines utilizing the high velocity air nozzles, systems have been employed which utilize centrifugal blasting wheels to propel or project the particulate abrasive material. Blasting apparatus of this type is shown in the Goff U.S. Pat. No. 3,788,010 and Fuma et al. U.S. Pat. No. 3,827,188. While these machines have the advantage of eliminating the large quantities of air supplied with the abrasive particles, the apparatus is rather heavy and cumbersome to handle, since the supply of grit or abrasive is carried by the machine and produces additional weight which must be manually shifted by the operator.

The present invention embodies apparatus having the advantages of the nozzle type machines which permit the use of lightweight apparatus by virtue of supplying the abrasive material from a remote source of supply, and at the same time incorporates the features of those machines which utilize centrifugal means for projecting the abrasive against the work surface. As a further feature of the invention, the invention has the further advantage of utilizing a projected stream of particulate abrasive which is transversely shaped to conform generally to an elongated rectangle. Provision is made for rotating the stream of material about its axis so as to be able to vary the width of the abraded area, between a minimum corresponding to the narrow width of the rectangle and a maximum corresponding to the length of the rectangle, when the apparatus is moved in a predetermined direction.

SUMMARY OF THE INVENTION

The present invention relates generally to abrasive blasting apparatus for use in the cleaning of a working surface and collecting the particles displaced from the surface along with the abrasive material, which particles are carried to a remote station for separation and reclaiming of the abrasive particles. More specifically, the invention is concerned with blasting apparatus of the type in which the abrasive is projected against the working surface by the centrifugal action of a rotatable impeller or wheel.

It is one object of the present invention to provide improved lightweight blasting apparatus which is easy to manipulate over a working surface, and which can be suspended by simple rigging for operation on a vertical surface.

A further object is to provide blasting apparatus of simple lightweight construction for projecting a stream of abrasive-laden air against a working surface, and in which the area of the surface being abraded is peripherally sealed, and in which a valved air passage is automatically operable to by-pass the seal in a controlled manner.

Another object is to provide an improved lightweight blasting apparatus of the centrifugal blasting type which utilizes a rotatable bladed impeller or wheel which is mounted in a separate chamber of the housing of the apparatus, the blades and surrounding portions of the housing having a protective liner material thereon for protecting the surfaces against erosion by the abrasive.

Still another object is to provide abrasive blasting apparatus of the centrifugal blasting type in which the projected blasting stream is transversely shaped so as to be of a substantially elongated rectangular configuration; and wherein provision is made for rotating the stream about its axis to vary its orientation and the width of the blasted area during movement of the machine in a given direction.

Further objects and advantages of the invention will be brought out in the following part of the specification, wherein detailed description is for the purpose of fully disclosing a preferred embodiment of the invention without placing limitations thereon.

BRIEF DESCRIPTION OF THE DRAWINGS

Referring to the accompanying drawings, which are for illustrative purposes only:

FIG. 1 is a schematic view showing the blasting apparatus of the present invention as being suspended by suitable rigging for vertical wall treatment, the blasting apparatus being connected to a remote supply station;

FIG. 2 is an elevational view of the blasting apparatus;

FIG. 3 is an enlarged vertical sectional view of the same, taken substantially on line 3—3 of FIG. 2;

FIGS. 7, 8 and 9 are top plan views of the blasting apparatus respectively illustrating adjusted positions of the abrasive projecting means to vary the width of the blasting path in a predetermined direction of movement of the apparatus.

DESCRIPTION OF A PREFERRED EMBODIMENT

Figures 4, 5, 6:
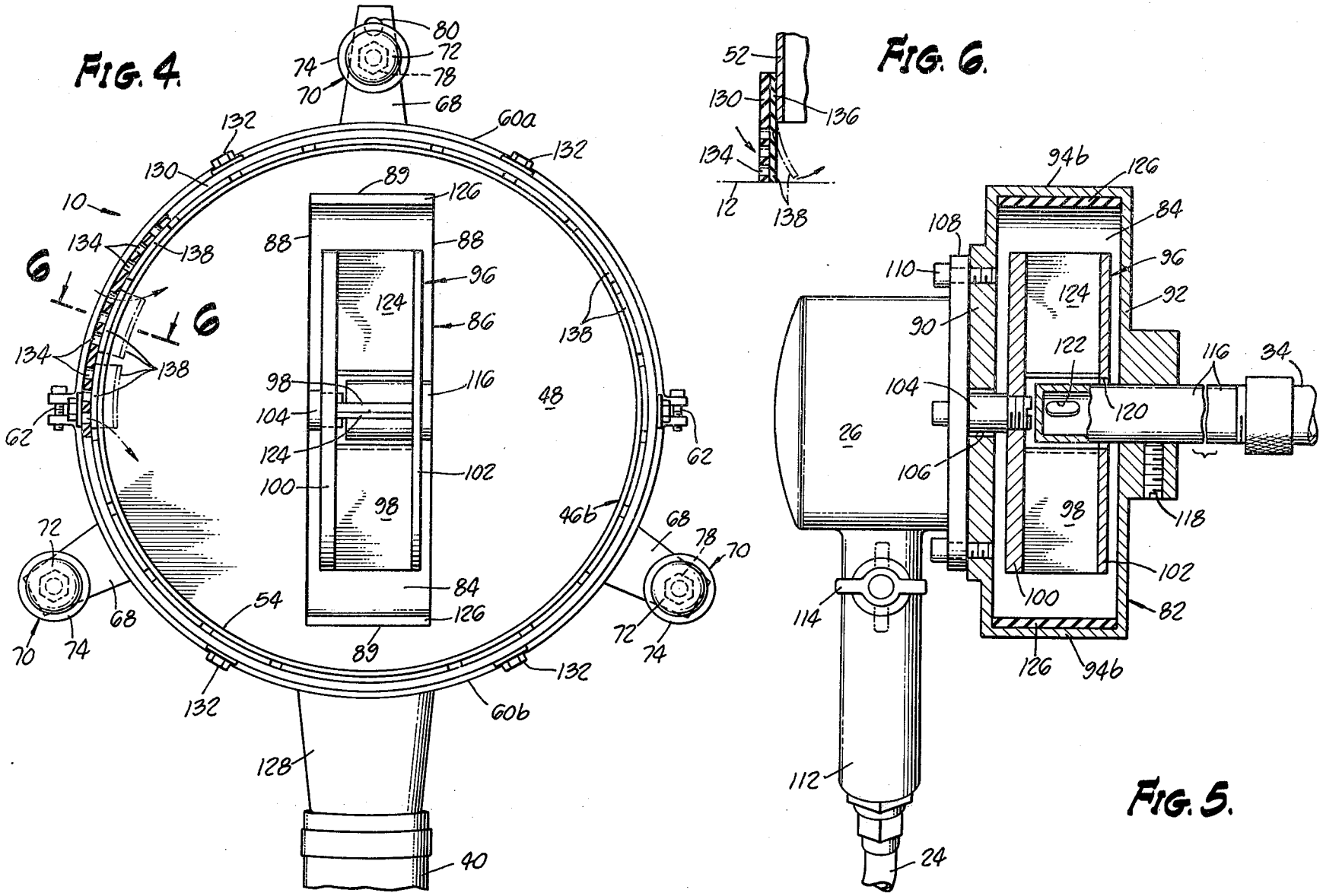
FIG. 4 is an enlarged bottom plan view partly in section to show details of the sealing means structure.
FIG. 5 is a sectional view taken substantially on line 5—5 of FIG. 3, and showing details of the abrasive impeller.
FIG. 6 is a fragmentary sectional view, taken substantially on line 6—6 of FIG. 4.

Referring more specifically to the drawings, for illustrative purposes, the apparatus, as generally indicated at 10, is shown as being utilized by an operator for the blasting of a vertical surface 12. As so used, an appropriate rigging is arranged to support the weight of the apparatus. The rigging arrangement may vary, but is here shown as comprising a conventional type of spring wound suspension cable 14.

The blasting apparatus is in this case operatively connected with a remote supply station, as generally indicated by the numeral 16, and which is connected with a pressurized air line 18 through a main control valve 20. A valve 22 is operable to connect the pressurized air with a distribution air line 24 for conducting operating air to the air motor 26 of the blasting apparatus.

Control valves 28 and 30 control the supply of pressurized air to a conventionally arranged pot 32 for the abrasive material, a branch line 34 having a connection with the bottom of the pot 32 for picking up abrasive therefrom and carrying it to the blasting apparatus.

The air line 24 also connects with and supplies operating pressurized air to a vacuum pump 36, this vacuum pump being connected with a vacuum tank 38 which is connected with a suction line 40 leading to the blasting apparatus. The suction line 40 contains a separator 42 which is positioned above the pot 32. The separator functions to reclaim the abrasive particles that are mixed with the particles removed from the blasted surface, the abrasive particles being discharged through an outlet opening 44 into the upper end of the pot 32. The waste particles are carried to the vacuum tank 38.

The details of construction of the blasting apparatus 10 of the present invention are specifically illustrated in FIGS. 2–5, and although the apparatus is shown in operative relationship with a vertical work surface, it will be readily appreciated that the apparatus may, with equal facility, be operatively associated with a horizontal work surface.

Referring particularly to FIG. 3, the apparatus comprises a housing structure, as generally indicated by the numeral 46, and is fabricated to provide interconnected sections **46*a* and 46*b***.

The housing section **46*a* comprises a transversely extending wall 48 having a circumferentially extending circular flange 50 which projects in one direction therefrom, and is arranged to telescopically receive one end of a cylindrical metallic ring structure 52 which forms the housing section 46*b*. The other end of the ring 52 defines a side opening 54 in facing relation to the adjacent work surface 12**.

As thus assembled, the ring 52 is rotatable within the flange 50. Provision is made for releasably securing the ring 52 and flange 50 in a desired relative rotational orientation. For this purpose, the flange 50 and ring 52 are provided with circumferentially extending exterior abutment radial flanges 56 and 58. These flanges are retained in sliding relation by means of a pair of inwardly grooved retaining ring sections **60*a* and 60*b* which are interconnected at their adjacent ends by conventional lug and bolt connecting means 62, as shown in FIG. 4. As thus arranged, the housing sections 46*a* and 46*b* are retained against separation, but may be relatively rotated. To prevent such rotation, and to permit securing the housing sections in a desired rotative orientation, a thumb screw is supported in a projecting lug 66 which is integrally formed on one of a plurality of circumferentially spaced radially outwardly projecting arms 68 which are integrally formed with the ring 52. The innermost end of the thumb screw is positioned to bear against one of the retaining ring sections 60*a* or 60*b*, and when tightened thereagainst serves to clampingly force the ring against the abutment flanges and prevent their relative rotational movement. However, by loosening the thumb screw 64** the housing sections may be relatively rotated for a purpose to be described later.

The open side of the ring 52 is adjustably supported in spaced relation with respect to the work surface 12 by means of a plurality of thrust members 70 in which a surface engaging ball 72 is rotatably supported in a cage member 74 that is secured to a threaded shank adjustably mounted in the arm 68 and arranged to be secured in adjusted position by a pair of securing nuts 78 positioned on opposite sides of the arm. Also, as shown in FIG. 3, the topmost lug in this case may be provided at its end with an opening 80 for attachment of the suspension cable 14 when using the apparatus on a vertical wall.

The housing section **46*a* is provided with a housing portion 82 which encloses a generally U-shaped chamber 84 in communication with the interior of the ring 52 by means of an elongate rectangular opening 86 formed in the transverse wall 48, this opening being defined by the long wall edges 88 and the shorter end edges 89, as shown in FIG. 4. As best shown in FIGS. 3 and 5, the housing portion 82 is constructed to provide spaced apart end walls 90 and 92, these end walls being bridged by a connecting wall 94 (FIG. 2) in which a generally semicircular portion 94*a* connects with parallel leg portions 94*b* respectively terminating at the end edges 89 of the rectangular opening 86**.

The abrasive projecting means are located in the chamber 84 and comprises a rotatably mounted impeller, as generally indicated by the numeral 96. As best shown in FIGS. 3 and 5, the impeller comprises a plurality of flat radial blades 98, illustrated as four in number, which are welded or otherwise fixedly secured between a pair of annular end walls 100 and 102. The end wall 100 is centrally secured to a drive shaft 104 of appropriate power means, the shaft passing through an opening 106 in the end wall 90. The power means may be of the electric or air type, but is illustrated as comprising the air motor 26 which is secured to the wall 90 by means of a mounting flange 108 and circumferentially spaced retaining bolts 110. The air motor housing includes an elongate tubular handle portion 112 which conducts the operating air from the air line 24 connected at its outermost end. If desired, a control valve 114 may be provided at the inner end of the handle for conveniently controlling the operation of the air motor.

For supplying abrasive-laden air to the impeller, a pipe member 116 is fixedly secured in a central hub portion of the wall 92 by means of a set screw 118. The pipe 116 is axially aligned with the drive shaft 104 and extends through an opening 120 in the end wall 102 of the impeller. The inner end of the pipe 116 is closed, and adjacent the closed end is provided with a radial opening 122 through which abrasive-laden air supplied through the branch line 34, which is connected to the outermost end of the pipe 116, may be discharged into the rotative path of movement of the inner ends of the blades 98 of the impeller during its rotation.

From the foregoing description, it will be apparent that if the impeller is rotated at a relatively high speed, the abrasive material in the air which is admitted through the opening 122 will be forcibly projected by the centrifugal force of the impeller in a stream through the rectangular opening 86 and through the side opening 54 against the working surface 12. Moreover, due to the passage of the stream through the rectangular opening 86, the stream will be transversely shaped to conform to the rectangular opening, and a correspondingly shaped area will be blasted on the working surface 12 within the circumferential confines of the ring 52.

In the conventional blasting device of the centrifugal type, a problem of erosion is presented with respect to the impeller blades and peripheral portions of the housing surrounding the impeller. In the present invention such erosion has been minimized and the life of the equipment greatly extended by providing surface liners or facings 124 of a hard erosion resistant metal or other suitable material on the leading faces of the radial blades 98. These facings may be welded or otherwise secured to the blades depending upon the material used. The inner surface of the connecting wall 94 is also provided with a protective liner 126 of rubber or other appropriate material. The ends of this lining extend through the ends of the rectangular opening 86.

For removing the spent abrasive along with particles of material which are removed from the working surface, the suction line 40 is connected to the interior of the ring 52 by means of a connection nipple 128.

The blasting operation is confined within the periphery of the opening 54 by the provision of unique sealing means between the working surface and the adjacent end of the ring 52. For this purpose, a generally cylindrical skirt 130 of slightly flexible material is secured along one edge margin to the adjacent edge margin of the ring 52 by means of a plurality of circumferentially spaced retaining bolts 132. Also, the marginal edge portion of the skirt, which extends beyond the ring 52, is provided with groups of air flow openings 134 peripherally arranged around the skirt in adjacent relation to the working surface engaging edge thereof. An inner concentric skirt 136 of a suitable resilient material is also secured by the retaining bolts 132 in a position overlying the innermost surface of the skirt 130. The skirt 136 is formed with resilient peripheral flaps 138, each of which flaps is of a size to cover a group of the flow openings 134 in valving operative relation. Normally, the flaps are resiliently urged in a direction to close the openings 134 to prevent the flow of outside air therethrough into the interior of the housing. However, the flaps are deflectable to regulate the flow of atmospheric air through the openings in response to variations in suction pressure within the housing.

The blasting apparatus of the present invention embodies a structure which is easily adjustable to permit it to operate most effectively and efficiently. For the most effective operation, a proper suction should be maintained within the housing in order to remove the spent abrasive and other particles and carry them to the separator 42 at the remote station for reclaiming of the abrasive particles for reuse in the blasting operations. Maintenance of suction within the housing necessitates the admission of a certain amount of air from the outside into the housing in order to relieve the seal between the skirt 130 and the working surface in order to enable movement of the apparatus across the work surface. The skirt functions for this purpose, as well as to prevent the abrasive and other particles within the housing from escaping into the atmosphere. The adjustment of the thrust members 70 enables the proper adjustment of the skirt engagement with the work surface for this purpose, and also for the purpose of maintaining a suction balance within the housing by the valving action of the flaps 138 to control the admission of atmospheric air through the openings 134 in response to the variation of suction pressure within the housing. Thus, the flaps provide a self-balancing type of one-way valve arrangement in that as the suction within the housing is reduced, the flaps will automatically be resiliently returned towards a position closing the openings 134 in the skirt.

As shown in FIGS. 7, 8 and 9, another important feature of the present invention resides in the ability to adjustably orient the transversely elongated shaped projected abrasive stream within the housing opening 54 in a manner to vary the width of the blasted working surface between a minimum and maximum width, with respect to movement of the apparatus in opposite directions along a predetermined line of movement. For example, let it be assumed that in FIGS. 7, 8 and 9 the apparatus is to be moved vertically, as might be the case in working on a vertical work surface. As illustrated in FIG. 7, if the housing sections are relatively adjusted so that the rectangular opening 86 is in axial alignment with the axis of movement of the apparatus, the blasted surface area will have a minimum width as indicated by the length of the arrow 140*a*.

As shown in FIG. 8, adjustment of the housing sections so as to dispose the rectangular opening 86 at an angle approximately 45°, the width of the blasted surface area will be proportionally increased as indicated by the arrow 140*b*.

If the angle is increased to 90°, or so that the longitudinal axis of the rectangular opening is transverse to that of the direction of movement of the apparatus as shown in FIG. 9, then a maximum width of blasted area will be obtained as indicated by the arrow 140*c*.

From the foregoing description and drawings, it will be clearly evident that the delineated objects and features of the invention will be accomplished.

Various modifications may suggest themselves to those skilled in the art without departing from the spirit of the disclosed invention and, hence, it is not wished to be restricted to the specific form shown or uses mentioned, except to the extent indicated in the appended claims.

What is claimed is:

1. Portable apparatus for blasting a surface with an abrasive material, comprising:

(a) a two-section housing in which one of the sections communicates with the other section through an elongate rectangular opening in a separating wall between the sections, said other section having a circular side opening with a perimeter outwardly spaced around said rectangular opening, and both of said openings being in facing relation to said surface;

(b) projecting means within said one section of the housing for propelling a particulate abrasive through said rectangular opening to form a transversely elongated stream of particulate abrasive material within the other section for engagement with said surface through said circular opening;

(c) resilient sealing means supported on said other section surrounding said circular opening and being adapted to contact the surface to establish a sealed relationship between the surface and said housing;

(d) means for supplying a particulate abrasive material to said projecting means;

(e) means to collect propelled abrasive material from within said other section; and (f) means for adjustably varying the orientation of said transversely elongated stream in a circumferential direction within said circular opening.

2. Apparatus as set forth in claim 1, wherein the projecting means comprises a rotatably mounted impeller within said one section having a plurality of radial blades, and in which the adjusting means includes means for angularly adjustably varying the position of said rectangular opening with respect to said other section.

3. Apparatus as set forth in claim 2, including means for delivering a stream of abrasive carrying air to the center of said impeller, whereby said abrasive will be projected toward said work surface.

4. Apparatus as set forth in claim 1, in which said housing sections are interconnected for relative rotational adjustment, and said one of said sections mounts said projecting means and said separating wall, and the other of said sections includes a surrounding wall structure extending from said separating wall and being provided with said side opening.

5. Apparatus as set forth in claim 4, which includes means for clampingly securing said housing sections in adjusted rotated position.

6. Portable apparatus as set forth in claim 1, which includes:

means for applying an air suction to said other section of the housing within the sealing means between said rectangular opening and said circular opening to collect propelled abrasive material from said surface; and means responsive to said air suction for variably controlling the admission of atmospheric air through said sealing means into said other section.

7. Apparatus as set forth in claim 6, in which the means for admitting atmospheric air comprises one-way valve means.

8. Apparatus as set forth in claim 7, in which said valve means includes at least one resilient flap member within said housing supported for movement between open and closed positions with respect to an air flow opening formed in said sealing menas.

9. Apparatus as set forth in claim 6, in which said sealing means includes a resilient skirt, and in which said means for admitting atmospheric air comprises a plurality of openings in said skirt, and a plurality of resilient flaps normally urged into closed relationship with respect to said openings, and into opened relation with respect to said openings by said air suction.

10. Apparatus as set forth in claim 9, which includes a plurality of independently adjustable thrust members extending from said other section for making contact with the work surface to control the amount of sealing engagement between the outer edges of said skirt and the work surface to facilitate the movement of said housing along the work surface.

11. Portable apparatus for blasting a surface with an abrasive material, comprising:

(a) a housing having a transverse wall, a side wall extending in one direction from the periphery of said transverse wall, and surrounding a circular opening in facing relation to said surface, and a housing portion extending in an opposite direction from said wall providing a chamber in communication with an elongate rectangular opening in said wall of a smaller area than said circular opening;

(b) an impeller with radially extending blades, rotatably supported in said chamber with its axis of rotation extending transversely of the rectangular opening and its plane of rotation extending lengthwise of the rectangular opening;

(c) a resilient sealing means supported on said side wall surrounding said circular opening and being adapted to contact said surface to establish a sealed relationship between the surface and said housing;

(d) means for supplying a particulate abrasive material to said impeller for propelling through said rectangular opening into engagement with said surface; and (e) said transverse wall, the housing portion and impeller being rotatably movable as a unit to vary the circumferential angular orientation of said rectangular opening within said circular bottom opening.

* * * * *